US005775163A

United States Patent [19]

Riedisser

[11] Patent Number: 5,775,163

[45] Date of Patent: Jul. 7, 1998

[54] TRANSFER ARRANGEMENT FOR MULTISTATION PRESSES

[75] Inventor: Günter Riedisser, Eislingen, Germany

[73] Assignee: Schuler Pressen GmbH & Co., Germany

[21] Appl. No.: 760,604

[22] Filed: Dec. 4, 1996

[30] Foreign Application Priority Data

Dec. 7, 1995 [DE] Germany ..... 194 45 570.3

[51] Int. Cl.[6] ..... B21D 43/05

[52] U.S. Cl. ..... 72/405.12; 72/405.11; 470/109; 470/154

[58] Field of Search ..... 72/405.12, 405.11, 72/405.09, 405.13, 405.01; 470/95, 109, 154

[56] References Cited

U.S. PATENT DOCUMENTS

| | | | |
|---|---|---|---|
| 2,544,218 | 3/1951 | Burdsall | 470/109 |
| 3,165,766 | 1/1965 | Wisebaker | 72/405.12 |
| 4,631,950 | 12/1986 | Hay | 72/405.12 |
| 4,898,017 | 2/1990 | Hite | 72/405.12 |

FOREIGN PATENT DOCUMENTS

| | | | |
|---|---|---|---|
| 0 041 690 B2 | 11/1988 | European Pat. Off. . | |
| 0 184 079 B1 | 7/1989 | European Pat. Off. . | |
| 23 32 194 A1 | 2/1975 | Germany . | |
| 34 43 874 A1 | 7/1986 | Germany . | |
| 328977 | 2/1972 | U.S.S.R. | 470/154 |
| 747588 | 7/1980 | U.S.S.R. | 72/405.01 |

*Primary Examiner*—Daniel C. Crane
*Attorney, Agent, or Firm*—Evenson, McKeown, Edwards & Lenahan, P.L.L.C.

[57] ABSTRACT

A transfer arrangement for a multistation press has two parallel gripper rails on a carrier and can be moved, together with the carrier, along a transfer curve. The gripper rails carry gripper fingers which are assigned to one another in pairs and which can be moved toward and away from one another by an oppositely directed movement of the gripper rails. The application movement is generated by parallelogram transmissions which are used for the bearing and for the drive of the gripper rails. The parallelogram transmissions are driven from a single drive source by a cardan shaft which permits the implementation of the transfer movement without any change of the relative position of the gripper fingers with respect to one another. Such a transfer arrangement is arranged on one side of the row formed by the tools and permits good access to the workpieces from the respective other side. As required, the entire transfer arrangement can be removed from the tool area, preferably in a swivel movement.

15 Claims, 3 Drawing Sheets

TRANSFER ARRANGEMENT FOR MULTISTATION PRESSES

BACKGROUND AND SUMMARY OF THE INVENTION

The present invention relates to a transfer arrangement for multistation presses, particularly for massive forming two translationally adjustable carrier devices each carrying a plurality of gripping devices having a gripping position and a releasing position and arranged parallel to a row of machining sites for workpieces. In particular, the present invention relates to a transfer arrangement for transfer presses in which the forming tools are arranged in a row.

Usually, transfer presses are used for extruding during which a desired workpiece is produced from a massive blank as the result of several successive forming steps. Separate tools are required for each forming step. Between the individual forming steps, the workpiece must therefore be conveyed from one tool to the next. In the case of multistation presses, the workpieces are arranged in a row on a common bedplate. Assigned top tools are fastened on a slide also in a row. The transfer arrangement has the task of conveying the workpieces in a timed manner from tool to tool when the slide releases the tools.

Although massive forming is particularly suitable for mass production in which large and repetitively identical workpiece lots must be machined, massive forming is increasingly used also for smaller workpiece lots. Because the forming tools are in each case used specifically for manufacturing a single workpiece type, a tool change is required when the multistation press is set up for a certain workpiece or during retooling.

If possible, the tool change must not be hindered by gripper devices standing in the area of the tools which are provided on the transfer arrangement for the workpiece transport. As a rule, the transfer arrangement used for the conveying of the workpieces has grippers which are adapted to a specific workpiece type. In addition to the workpiece change, a gripper change is required when the multistation press is to be retooled.

DE 34 43 874 A1 describes a transfer arrangement for transferring workpieces in a multistation press. This transfer arrangement has a set of tongs which are held on mutually parallel arms. The arms are arranged approximately at a right angle with respect to a line which is defined by the row of successive workpieces. During the transfer of the workpieces, the arms are swivelled synchronously to the side in which case the tongs are moved on approximately semicircular paths. The tongs are opened and closed at the individual tool positions, for which separate driving devices are used. These devices have transmissions which are provided on the arms, extend through these and are driven by cam plates. In an alternative embodiment, the tongs are provided in a purely passive manner with spring clamping devices.

For the workpiece transfer, individual tongs are provided whose drive and/or adjusting can result in relatively high expenditures.

A multistation forming machine for massive forming is described in EP 00 41 690 B1. The forming machine has several tool stations which are arranged in a row on a support and through which a massive blank must travel. For transferring the blank from one tool station to the next, a tong apparatus is provided which has two tong boxes displaceable translationally in a synchronous manner with respect to one another. One tong box with rigidly constructed tongs is arranged on one side of the row defined by the tool stations and another tong box with elastically constructed tongs is arranged on the other side. Each tong box is driven such that, in addition to its translational movement, it can also carry out an angular movement about its translation axis. This results in a movement toward and away form one another of tong halves which are situated opposite one another and are assigned to one another. Because of the two-sided arrangement of the tong halves with respect to the tools, the access to the tools is made difficult, which can be particularly significant during retooling.

An object of the present invention is to provide a transfer arrangement for multistation presses which can be retooled in a simple manner. In addition, the transfer arrangement must have a simple construction, operative precisely and itself be retoolable in a simple manner.

These objects have been achieved in accordance with the present invention by providing that the carrier devices are mutually parallel gripper rails arranged on one side of a row defined by the machining sites.

The carrier devices constructed as gripper rails are arranged on one side of the tool row and therefore expose the other side (front side) of the tools. In contrast to the prior art in which carrier devices for the grippers constructed as flaps or cheeks are arranged on both sides of the workpieces, the access to the tools in accordance with the present invention is substantially improved. This is achieved without the disadvantage of more complicated gripping devices as would occur if gripping tongs or similar devices were used. In addition, the basic construction of the present invention permits a precise and secure gripping of the workpieces and an accurate insertion of the workpiece into the respective tool which follows.

Advantageously, the gripper devices are formed by grippers which each contain two gripper fingers. The first gripper fingers are connected with the first gripper rail and the second gripper fingers are connected with the second gripper rail. A translational, oppositely directed adjustment of the gripper rails in their respective longitudinal direction therefore permits an opening and closing of all grippers. The movement in the opposite direction with respect to the workpiece allows the clamped workpiece to be held in the same position as the workpiece which is freely disposed in the respective tool. In this manner, a tilting, canting or slanted insertion of the workpieces is excluded.

Although it is within the contemplation of the present invention to construct the gripper fingers resiliently in a certain area, it is advantageous for them to be essentially rigidly constructed extension arms which extend away from the respective gripper rail. The gripper fingers have a constructively simple design and the adjusting expenditures are minimized.

A solution which permits a particularly simple exchange of grippers is obtained if the gripper fingers are connected with an attachment rail which is releasable held on the gripper rail. For exchanging the grippers, only changing of the attachment rails is required and, in the simplest case, only two screwed connections having to be released for each attachment rail. The gripper fingers provided for a respective workpiece type remain fixedly connected with the attachment rail and preadjusted with respect thereto.

Preferably, the gripper rails are carried by a common carrier device which is movably disposed with respect to the multistation press and can be adjusted in a targeted manner by corresponding driving devices. The carrier device can be lifted and lowered, and adjusted in the longitudinal direction. Carriages or linear guides hold the gripper rails on the carrier device in a longitudinally adjustable manner. As a result, the opening and closing movement of the gripper fingers is independent of the transport movement to which the entire carrier device is subjected.

Another advantageous feature of the invention is that the carrier device, together with both gripper rails and the gripper fingers held thereon, are swivellable from the vicinity of the tools into a rest position which is farther away from the tools. This rest position provides free access to the tools and permits a particularly simple tool change. During the swivelling into the rest position, the carrier device and the gripper rails are preferably swivelled about ar axis of rotation parallel to the longitudinal course of the gripper rails.

A mechanically particularly reliable, fast-running and precise construction of the transfer arrangement according to the present invention has a common driving device for the oppositely directed longitudinal adjustment of the gripper rails for opening and closing the grippers and for the transfer movement to which the carrier device and therefore the two gripper rails are subjected in a synchronous manner. Such a driving device is, for example, a central shaft with cam plates connected with a worm gear via a gear wheel. The axis of rotation of the worm gear is simultaneously the axis of rotation about which the carrier device is swivelled during the swivelling into and out of its rest position. Thereby, the carrier device and the driving devices assigned thereto are swivellable about an otherwise inoperative drive. The solution is mechanically simple and robust.

The translational movement for opening and closing of the gripper rails is obtained in simple manner by carrying the gripper rails by two crank rods disposed on the carrier device. The advantage and the special feature of this solution is the fact that, during the changing of the gripper fingers into the respective gripping position, a circular-arcshaped application movement to the individual workpieces is carried cut. As a result, the lateral application movement of the gripper fingers will disappear almost completely shortly before the gripper fingers come in contact with the workpiece. Thus, despite the lateral application of the gripper fingers, a pure clamping movement with respect to the workpieces is achieved and a lateral displacing and tilting of the workpieces is avoided.

The driving of the gripper rails preferably takes place by a toothed rack which is disposed parallel to the gripper rails on the carrier device and is driven by a gear wheel pinion. This pinion, in turn, is driven by way of a cardan shaft which derives its movement from a cam plate. The cardan shaft permits the translational movement of the carrier device while taking along the gear wheel pinion without rotation. This results in an uncoupling of the transfer movement (lifting, lowering, advancing; i.e., the synchronous movement of both gripper rails) from the gripping movement (oppositely directed movement of the gripper rails).

BRIEF DESCRIPTION OF THE DRAWINGS

These and other objects, features and advantages will become more apparent from the following detailed description of the preferred embodiments when taken in conjunction with the accompanying drawings wherein.

DETAILED DESCRIPTION OF THE DRAWINGS

Figure 1:
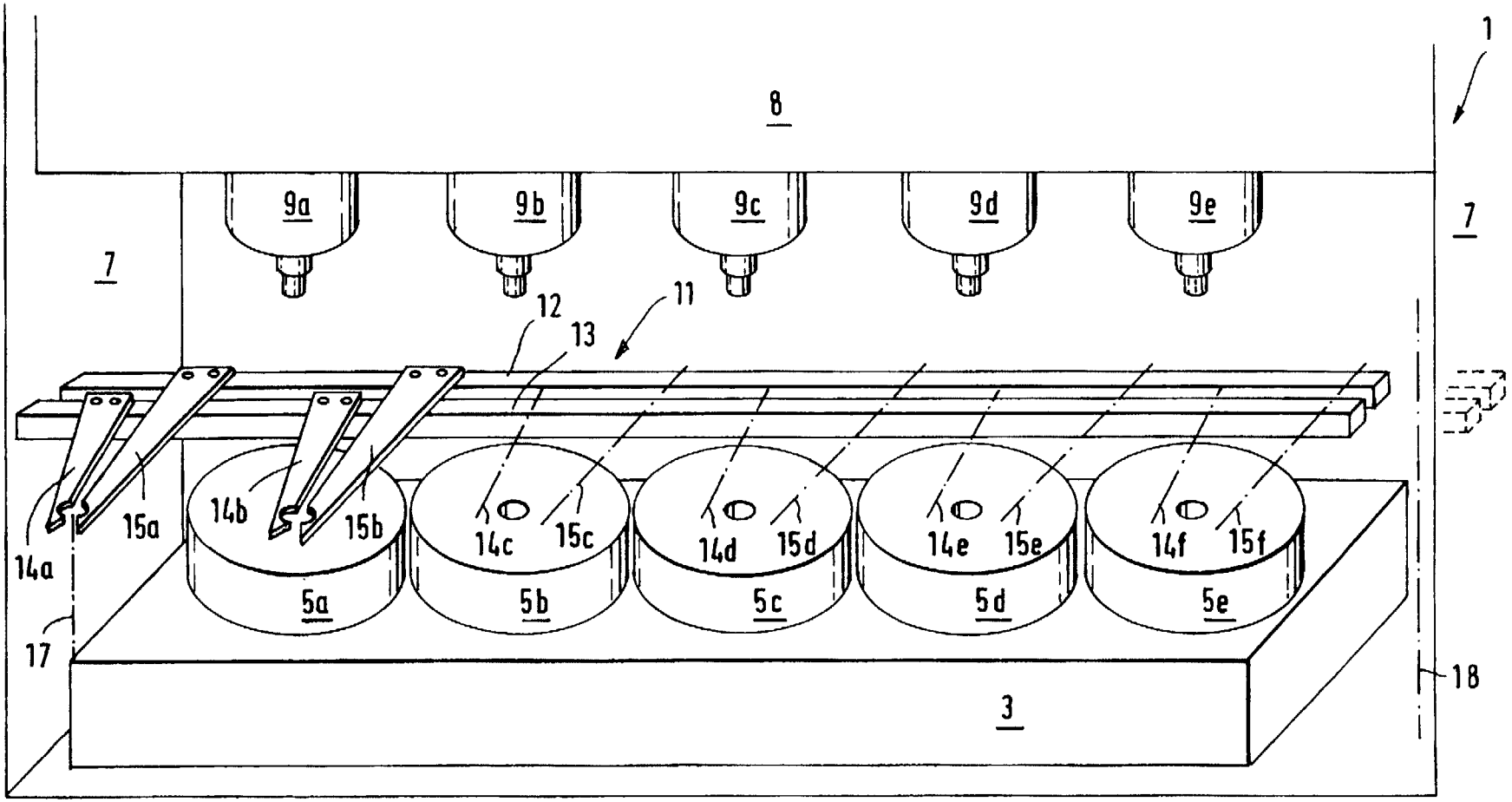
FIG. 1 is a perspective schematic view of a multistation press for a massive forming with a transfer arrangement which has two gripper rials and is arranged on one side of the tools in accordance with the present invention.

In FIG. 1, multistation press designated generally by numeral 1 is used for the massive forming of workpieces along five tool stations. The multistation press 1 has a bedplate 2 on which a basic tool frame 3 is stationarily disposed and carries a total of five tool stations which are symbolically shown by flat cylinders with female molds 5*a* to 5*e* which collectively are referred to hereinafter as female molds 5.

A slide 8 is disposed in a press frame and can be moved toward and away from the female molds 5. This slide 8 carries male molds 9*a* to 9*e* which are assigned to the individual female molds 5*a* to 5*e* and which are used as top tools for forming workpieces (not shown) situated in each of the female molds 5*a* to 5*e*.

For conveying the workpieces from the female mold 5*a* to 5*d* to the respective next female mold 5*b* to 5*e* or for introducing the workpieces into the female mold 5*a* and removing the completely formed workpiece from the female mold 5*e*, a transfer arrangement designated generally by numeral 11 is outlined in FIG. 1 by two gripper rails 12, 13 as well as gripper fingers 14*a* to 14*f*, 15*a* to 15*f* carried thereby. For five tool stations, six gripper finger pairs are therefore provided in order to be able to service, in addition to the tool stations, a schematically shown (dot-dash line) transfer station 17 and a travel-out station 18 which are arranged at the start and the end of the tool row defined by the individual female molds 5*a* to 5*e*.

Figure 2:
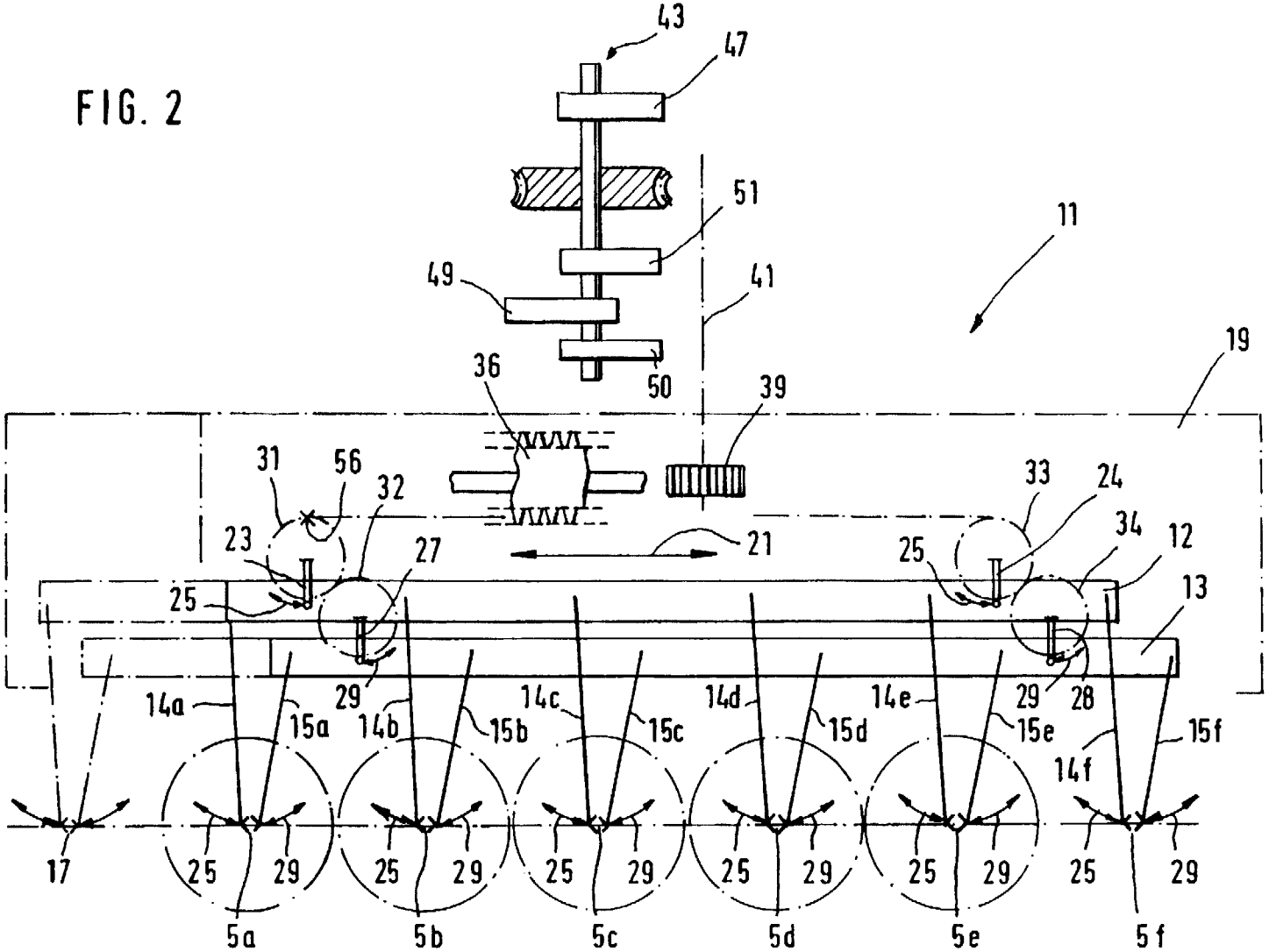
FIG. 2 is a schematic top view of the transfer arrangement of the multistation press according to FIG. 1.
Figure 3:
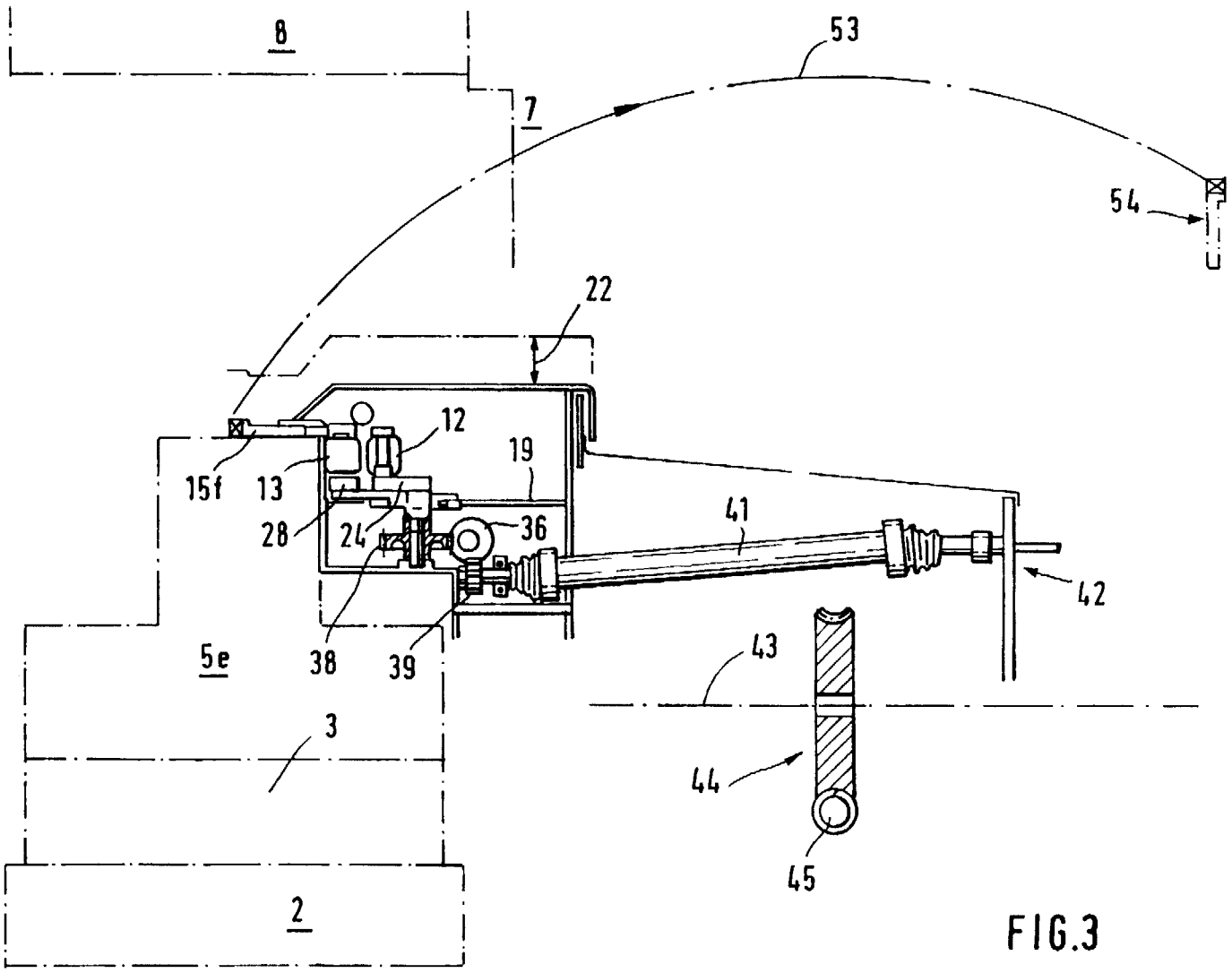
FIG. 3 is a schematic and simplified cross-sectional view of the multistation press according to FIG. 1 with the transfer arrangement according to FIG. 2.

As illustrated particularly in FIG. 3, the gripper rails 12, 13 are disposed on a common carrier 19 moveable in the vertical or stroke direction as well as parallel to the longitudinal or transport course of the gripper rails 12, 13. The transport direction is illustrated in FIG. 2 by a doubleheaded arrow 21, and the stroke direction is shown in FIG. 3 by a double-headed arrow 22.

On the end side, the gripper fingers 14*a* to 14*f* are equipped with a suitable gripper surface and are aligned parallel to one another. On their ends pointing away from the female molds 5, the gripper fingers are each rigidly connected with the gripper rail 12. In contrast, the gripper fingers 15*a* to 5*f*, which are provided with corresponding gripping surfaces and arranged parallel to one another, are fixedly connected with the gripper rail 13. In order to be able to transfer a gripper finger pair each comprising a gripper finger 14 and a gripper finger 15 optionally into the gripping position and into the release position, the gripper rails 12, 13 can be moved with respect to one another. For this purpose, the gripper rail 12 is carried by two crank rods 23, 24 which are rotatably disposed about a vertical axis on the carrier 19. As a result, the crank rods 23, 24, together with the gripper rail 12, define a parallelogram linkage and guide the gripper rail 12 on a circular path outlined by arrows 25. The gripper-side ends of the gripper fingers 14*a* to 14*f* carry out a corresponding identical movement.

The gripper rail 13 is also carried by crank rods 27, 28 which are rotatably disposed parallel to one another on the carrier 19 and, together with the carrier rail 13, therefore define a parallelogram linkage. The length coincides with the lengths of the crank rods 23, 24. The resulting movement of the gripper rail 13 and of the gripper fingers 15*a* to 15*f* is illustrated by arrows 29. The crank rods 23, 27 and the crank rods 24, 28 each mesh with one another in pairs by way of schematically shown gear wheels 31, 32 and 33, 34. In this case, the gear wheels are sized and arranged such that the driven crank rods 23, 27 and 24, 28, in each case rotate in pairs in opposite directions equally fast.

For driving the crank rods 23, 27 and 24, 28, a toothed rack 36 is longitudinally slidably disposed on the carrier 19 via a gear wheel 38 illustrated in FIG. 3, the toothed rack 36 drives the crank rod 24 which, in turn, drives the crank rod 28 in the opposite direction. Likewise, via a gear wheel not shown in detail, the toothed rack 36 drives the crank rod 23 which, in turn, drives the crank rod 27. A rotation of the crank rods 23, 27 and 24, 28 and therefore a relative movement of the gripper rails 12, 13 will take place only when the toothed rack 36 is displaced with respect to the carrier 19.

For driving the toothed rack 36 with respect to the carrier 19, a gear wheel pinion 39 is rotatably disposed on the carrier 19 which meshes with the toothed rack 36. By way of a cardan shaft 41, the gear wheel pinion 39 is connected with a drive 42. The cardan shaft 41 permits a translational movement of the gear wheel pinion 39 in the direction of the arrow 21 without causing a rotation of the gear wheel pinion 39.

A control shaft 43 is used as the drive 42 for the gear wheel pinion 39 and thus for the opening and closing of the gripper finger pairs, and via a gear wheel 44, is driven by a worm gear 45 as best seen in FIG. 3. The continuously rotating worm gear 45 drives the control shaft 43 synchronously to the working strokes of the slide 8. The continuous movement of the control shaft 43, by way of a cam plate 47, a lever and a gear wheel tap causes a periodic targeted movement of the gear wheel pinion 39. Additional cam plates 49, 50, via a conventional lever drive, cause the transport or advancing movement of the carrier 19 in the direction of the arrow 21 in FIG. 2. In contrast, the lifting and lowering of the carrier 19 is derived from a cam plate 51 which is disposed on the control shaft 43 and causes the lifting and lowering of the carrier 19 by way of corresponding lever transmissions.

The transfer arrangement 11 including the control shaft 42 form a constructional unit which, as indicated in FIG. 3, can be swivelled from the working position into a rest position. During the swivelling into the rest position, the gripper fingers 14, 15 cover the path 53 indicated by a dotlong dash line. The rest position of the gripper fingers is indicated at reference number 54. In this case, the swivel axis is the rotation axis of the worm gear 45, in which case the gear wheel 44 is also swivelled about the worm gear 45.

In operation of the multistation press 1 described above, the gripper fingers 14*a*–14*f*, 15*a*–15*f* are in an almost closed and withdrawn position during a working stroke of the slide 8. In this position, the crank rods 23, 27 and 24, 28 are rotated by approximately 180° against the respective position illustrated in FIG. 2. The gripper rails 12, 13 are in their position which is removed as far as possible from the respective female molds 5*a* to 5*e*. During this time period, the cam plates 49, 50 cause a displacement of the carrier 19 in the direction of the transfer station 17; that is, toward the left in FIG. 2. When this position has been reached and the slide 8 has moved upward so far that the female molds 5*a* to 5*e* are free, the cam plate 47 reaches an area in its rotation in which it starts to rotate, by way of the cardan shaft 41, the gear wheel pinion 39 so that the toothed rack 36 is displaced toward the left in FIG. 2. For this reason, for example, the crank rod 23 moves from its position indicated by a cross 56 into the illustrated position. The crank rod 24 rotates correspondingly.

While the crank rods 23, 24 move counterclockwise, the crank rods 27, 28 in FIG. 2 rotate clockwise and also from their position pointing away from the female molds 5*a* to 5*e* into the illustrated position pointing toward them. The gripping fingers 14, 15 each close in a tong-like manner on a circular arc which is indicated by the arrows 25, 29. As a result, the workpieces which are situated in the transfer station 17 as well as in the tool stations which follow are gripped by the gripping fingers 14, 15. At this point in time, a non-inclined area of the cam plate 47 is reached so that the gear wheel pinion 39 stops rotating.

The cam plate 51 now controls a stroke movement whereby the carrier 19, the gripper rails 12, 13, the grippers 14, 15 and the workpieces situated therein are lifted. Shortly thereafter or overlapping with respect to time, the transfer movement toward the right in FIG. 2, i.e., a movement toward the fall-out station 18, starts and is caused by the cam plates 49, 50. The stroke of the transfer movement corresponds precisely to a spacing of the female molds 5*a* to 5*e* which are uniformly spaced from one another. Toward the end of the transfer movement, the carrier 19 is lowered and, by way of the cam plate 47, the cardan shaft 41, the gear wheel pinion 39 and the toothed rack 36, the crank rods 23, 27 and 24, 28 are driven such that the gripper rails 12, 13 are swivelled away from the female molds 5 on oppositely directed circular arcs with the gripper fingers 14, 15 thereby carrying out semicircular opening movements in the direction of arrows 25, 29. Upon conclusion of these opening movements, the male molds 9, which are fastened on the slide 8 and are moving downward, impact on and deform the workpieces.

With the illustrated transfer device 11, a secure gripping of the workpieces is achieved. The grippers move almost precisely in the opposite direction toward and away from the particular workpiece. Thus, no impulse is exercised on the workpiece which could lead to a tilting or canting. By way of the forced guiding of all movements required for the workpiece transport derived from the single drive worm gear 45, a precise implementation of all movements is achieved. Furthermore, the entire transfer arrangement 11 forms a unit which can be removed from the tool area in a simple folding movement. This is used for changing the tools as well as for changing the gripper rails 12, 13 or individual gripper fingers 14, 15.

Alternatively, the gripper fingers 14, 15 can be held on attachment rails which are carried by the gripper rails 12, 13. Such an alternative embodiment has the advantage that, for the retooling to other workpieces to be machined, the gripper fingers can be easily exchanged by a few manipulations. This arrangement significantly improves the operability of the tool space and the tool change is facilitated. No manual removal of the gripper rails is required when measures are to be carried out on the tools. Also, instead of the toothed rack for driving the crank rods, other driving devices, such as toothed belts, chains or the like, can be used.

In summary, a transfer device for a multistation press has two gripper rails which are disposed parallel to one another on a carrier and moved together with the carrier along a transfer curve. The gripper rails carry gripper fingers which are assigned to one another in pairs and which, via an oppositely directed movement of the gripper rails, are moved toward and away from one another. The application movement is generated by parallelogram transmissions which are used for bearing and driving the gripper rails. The parallelogram transmissions are driven from a single drive source by way of a cardan shaft which permits the implementation of the transfer movement without any change of the relative position of the gripper fingers with respect to one another. Such a transfer arrangement is arranged on one side of the row formed by the tools and therefore permits a good access to the workpieces from the other side. As required, the entire transfer arrangement can be removed from the tool area, preferably by way of a swivel movement.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Transfer arrangement for a multistation press, comprising two translationally adjustable carrier devices, each carrying a plurality of complementary gripping devices forming pairs from the respective gripping devices on each of the carrier devices and having a gripping position and a releasing position and arranged parallel to a row of machining sites for workpieces, the complementary gripping devices establishing two parts of the pair and being arranged so that each part of each pair is carried by only one of the respective carrier devices, wherein the carrier devices are mutually parallel gripper rails arranged on one side of a row defined by the machining sites.

2. The transfer arrangement according to claim 1, wherein the gripper devices comprise grippers which each contain two gripper fingers having a first finger carried by a first of the gripper rails and second finger carried by a second of the gripper rails, and for gripping and releasing a workpiece, the gripper rails are adjustably arranged in respective opposed longitudinal directions thereof with respect to the workpiece.

3. The transfer arrangement according to claim 2, wherein the gripper fingers are substantially rigid extension arms extending away from the associated gripper rail.

4. The transfer arrangement according to claim 2, wherein during gripping and releasing movement, the gripper fingers are each guided in circular arc-shaped paths.

5. The transfer arrangement according to claim 1, wherein the gripper rails are carried by a common carrier device and are movably disposed with respect to the multistation press.

6. The transfer arrangement according to claim 1, wherein the carrier device is arranged to be swivellably moveable away from the machining sites into a rest position.

7. The transfer arrangement according to claim 6, wherein the carrier device is swivellably moveable about a swivel axis parallel to a line defined by the machining sites.

8. The transfer arrangement according to claim 5, wherein the carrier device is configured to carry transmission devices for oppositely directed longitudinal adjustment of the gripper rails with respect to the carrier device which transmission devices are connected with a common drive.

9. The transfer arrangement according to claim 1, wherein during a change between the gripping position to the releasing position, the gripper rails are arranged to carry out a transverse movement.

10. The transfer arrangement according to claim 8, wherein each gripper rail is carried by crank rods driven by a central drive via transmission devices.

11. The transfer arrangement according to claim 9, wherein each gripper rail is carried by crank rods driven by a central drive via transmission devices.

12. The transfer arrangement according to claim 5, wherein the carrier device is arranged to be moveable by a stroke device perpendicularly to a longitudinal direction thereof such that the gripper fingers are moveable toward and away from the tools for receiving workpieces on the multistation press.

13. The transfer arrangement according to claim 5, wherein the carrier device is arranged to be moveable by an advancing device along a longitudinal direction thereof such that the gripper fingers are moveable parallel to a row of tools which are provided for receiving workpieces at the multistation press.

14. The transfer arrangement according to claim 10, wherein a central drive drives the gripper rails in a gripping movement thereof and the carrier device in an advancing movement and a lifting movement thereof.

15. The transfer arrangement according to claim 14, wherein the gripper rails are driven by the central drive via a cardan shaft.

* * * * *